US007934522B2

(12) United States Patent
Liao et al.

(10) Patent No.: US 7,934,522 B2
(45) Date of Patent: May 3, 2011

(54) MULTI-SECTIONAL AIRTIGHT SEAL FOR CONTINUOUS AIR-FILLING AND AIR VALVE DEVICE THEREOF

(75) Inventors: Chian Hua Liao, Sindian (TW); Yao Sin Liao, Sindian (TW); Yao Chuan Liao, Sindian (TW)

(73) Assignee: Yao Sin Liao, Sindian, Taipei County (TW)

( * ) Notice: Subject to any disclaimer, the term of this patent is extended or adjusted under 35 U.S.C. 154(b) by 1176 days.

(21) Appl. No.: 11/609,335

(22) Filed: Dec. 12, 2006

(65) Prior Publication Data

US 2008/0060718 A1 Mar. 13, 2008

(30) Foreign Application Priority Data

Sep. 7, 2006 (TW) ..... 95133067 A

(51) Int. Cl.
*B65B 3/16* (2006.01)

(52) U.S. Cl. ..... 141/114; 141/10; 141/67; 141/313; 141/317; 156/145; 156/147

(58) Field of Classification Search ..... 141/1, 10, 141/67, 68, 70, 164, 166, 177, 313–317; 156/145, 147
See application file for complete search history.

(56) References Cited

U.S. PATENT DOCUMENTS

| | | | | |
|---|---|---|---|---|
| 4,850,912 A | | 7/1989 | Koyanagi | |
| 5,427,830 A | | 6/1995 | Pharo | |
| 5,469,966 A | * | 11/1995 | Boyer | 206/522 |
| 6,067,778 A | * | 5/2000 | Yamamoto et al. | 53/451 |
| 6,213,167 B1 | * | 4/2001 | Greenland | 141/10 |
| 7,204,278 B2 | * | 4/2007 | Koyanagi et al. | 141/114 |
| 7,249,612 B2 | * | 7/2007 | Koyanagi | 137/846 |
| 7,481,252 B2 | * | 1/2009 | Koyanagi | 141/114 |
| 7,568,508 B2 | * | 8/2009 | Liao et al. | 141/114 |

FOREIGN PATENT DOCUMENTS

| | | | |
|---|---|---|---|
| JP | H03-112371 | U | 11/1991 |
| JP | 2006-117311 | A | 5/2006 |
| KR | 100192653 | B1 | 1/1999 |
| KR | 1020050005230 | A | 1/2005 |
| KR | 100491204 | B1 | 5/2005 |
| KR | 100763641 | B1 | 9/2007 |
| KR | 100807755 | B1 | 2/2008 |
| WO | 90/09320 | A2 | 8/1990 |

* cited by examiner

*Primary Examiner* — Timothy L Maust
(74) *Attorney, Agent, or Firm* — Apex Juris, pllc; Tracy M Heims

(57) ABSTRACT

A multi-sectional airtight seal for continuous air-filling includes: an input passage; plural first sub-tubes aligned parallel to a lateral side of the input passage; plural first valve devices including a first filling passage and a second filling passage with the first filling passage connecting the first sub-tubes and the input passage; plural second sub-tubes serially connecting the first sub-tubes; and plural second valve devices for connecting the second sub-tubes and the second filling passages to allow through-linking between the second sub-tubes and the input passage. When external air in the input passage enters through the first filling passage of the first valve device to fill and expand the first sub-tubes, the second sub-tube is filled through the second filling passage and the second valve device to be expanded as well.

16 Claims, 17 Drawing Sheets

MULTI-SECTIONAL AIRTIGHT SEAL FOR CONTINUOUS AIR-FILLING AND AIR VALVE DEVICE THEREOF

BACKGROUND OF THE INVENTION

1. Field of Invention

The present invention relates to airtight seal and air valve device, and more particularly to a multi-sectional airtight seal for continuous air-filling and an air valve device thereof.

2. Related Art

A convention way for buffer packing is mostly to use a plastic sheet configured with plural raised tiny gasbags to cover outside an article and achieve shock-absorption and cushion effects. However, the tiny gasbags have limited shock-absorption capability and fail to absorb or buffer a greater vibration or impact load. Therefore, an air-packing bag made of resin film was developed.

Please refer to FIGS. 1A-1C. An air-packing bag A10 includes an input hole A11 and a filing path A12 connecting with the input hole A11. Both sides of the filing path A12 connect with plural chambers A13 respectively. Each of the chambers A13 is configured with an air valve A14 composed by a upper valve film A141 and a lower valve film A142. After the gas in the input hole A11 is filled in to the chambers A13 through the filing path A12, the air-packing bag A10 is filled and expanded to function as a cushion material; for example, U.S. Pat. No. 4,850,912 "Container for sealingly containing a fluid", and U.S. Pat. No. 5,261,466 "Process for continuously filling fluid into a plurality of closed bags", and Japan Patent Publication No. "Seal Bag for Fluid". However, this type of air-packing bag A10 need to configure with plural ones of the filing paths A12 for filling air into the plural chambers A13. Besides, the plural independent chambers A13 cannot share the same air valve A14 to fill air.

Please refer to FIG. 1D. The air-packing bag A10 is configured with plural nodes A15 on the chambers A13 for bending the chambers A13 to form plural sub-chambers, thereby packing an article and providing buffer protection; for example: U.S. Pat. No. 6,629,777 "Buffer packing bag" and Taiwan Utility Patent Publication No. M292564 "Air-packing bag equipped with plural auxiliary tubes". However, if any of the sub-chambers in this type of air-packing bag A10 is broken, all the air inside the chambers A13 will be leaking out. It cannot provide a sectional independent sub-chamber by filling a single chamber A13 for a single time.

Please refer to FIGS. 2A to 2C, which illustrates U.S. Pat. No. 5,427,830 "Continuous, inflatable plastic wrapping material". The filing path A12 of the air-packing bag A10 is formed by thermal-sealing the upper valve film A141 and the lower valve film A142 with the filing path A12 attaching tightly to the outer film A161 and passing through plural chambers A13. However, this type of air-packing bag A10 can only have the chambers A13 in a horizontal parallel alignment to be filled by the single filing path A12. If a vertical serial alignment is applied to the chamber A13, it has to be filled by sections. Furthermore, the chamber A13 uses the thermal-sealed line A17 to split into plural sub-chambers. If any of the sub-chambers in this type of air-packing bag A10 is broken, all the air inside the chambers A13 will still be leaking out. It yet fails to provide a sectional independent sub-chamber by filling a single chamber A13 for a single time.

Please refer to FIGS. 3A and 3B. An air-packing bag A10 is composed by two outer films A161, A162, which are made of soft resin, to form a seal for air-filling. Between the outer films A161, A162, an air valve A14 is configured by stacking and partially attaching the upper valve film A141 to the lower valve film A142 to form air passages between the upper valve film A141 and the lower valve film A142; for example, Taiwan Invention Patent Publication No. 587049 "Configuration Structure for On/Off Valve of Seal and Manufacture Apparatus for Seal with On/Off Valve". However, the air valve A14 of the air-packing bag A10 is not capable of filling the plural chambers A13. Besides, only if the chambers A13 are added in a horizontal parallel alignment, air-filling can be made through the single filing path A12. If a vertical serial alignment is applied to the chambers A13, it has to be made by sections.

Therefore, improving the structure of the air-packing bag to allow plural vertical serial-aligned chambers to be filled at the same time and prevent all the chambers from leaking air when any of the sub-chambers is broken, becomes an issue that the inventor of the present invention and those practicing in the art are eager to develop.

SUMMARY OF THE INVENTION

Accordingly, the present invention provides a multi-sectional airtight seal for continuous air-filling, including: an input passage; plural first sub-tubes aligned parallel to a lateral side of the input passage; plural first valve devices including a first filling passage and a second filling passage with the first filling passage connecting the first sub-tubes and the input passage; plural second sub-tubes serially connecting the first sub-tubes; and plural second valve devices for connecting the second sub-tubes and the second filling passages to allow through-linking between the second sub-tubes and the input passage.

The present invention also provides a multi-sectional airtight seal for continuous air-filling, including: an input passage; plural main air tubes, aligned parallel to a lateral side of the input passage; plural single-path valve devices for connecting the main air tubes and the input passage; and plural auxiliary tubes, located at an end of each of the plural main air tubes. Each of the auxiliary tubes includes: a first sub-tube serially connecting with one of the main air tubes; a first valve device including a first filling passage and a second filling passage with the first filling passage connecting the first sub-tube and the main air tube; a second sub-tube, serially connecting with the first sub-tube; and a second valve device for connecting the second sub-tube and the second filling passage to allow through-linking between the second sub-tube and the main air tube.

By means of configuring the first valve devices and the second valve devices, external air is allowed to enter and expand the first sub-tubes and the second sub-tubes at the same time. Not only filling speed of the first sub-tubes and the second sub-tubes is faster, the shock-absorption and cushion capabilities are also maintained by the checking capability of the first valve devices and the second valve devices without leaking from other air tubes when any of the air tubes is broken.

The present invention provides an air valve device equipped with a multi-sectional airtight seal for continuous air-filling, configured in a plurality of serial-connecting air tubes formed by thermal-sealing two outer films to allow through-linking between the plurality of serial-connecting air tubes, the air valve device comprises: a upper inner film; a lower inner film staked with the upper inner film; a first filling passage, formed by applying heatproof material between the upper inner film and the lower inner film and thermal-sealing the upper inner film and the lower inner film; and a second filling passage, formed by applying heatproof material between the upper inner film and one of the outer films and thermal-sealing the upper inner film and said outer film.

By providing a structure of the air valve device equipped with the first filling passage and the second filling passage, external air is allowed to fill through the first filling passage and expand one of the air tubes, and meanwhile another of the air tubes is filled through the second filling passage to be expanded. The filling speed of the air tubes is accelerated, and the shock-absorption and cushion capabilities are also maintained without leaking from other air tubes when any of the air tubes is broken.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1A:
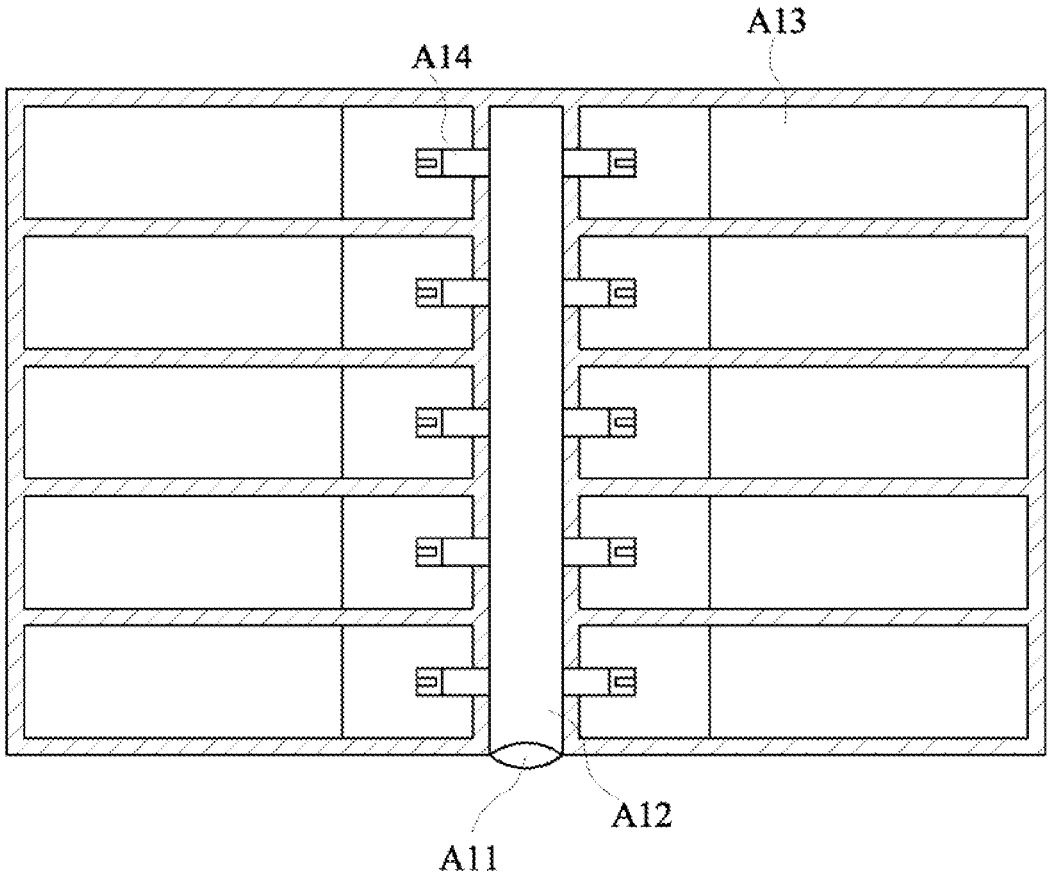
Fig.1A(PRIOR ART)
FIG. 1A is an explanatory diagram of an air-packing bag in the prior art before filling air (1).
Figure 1B:
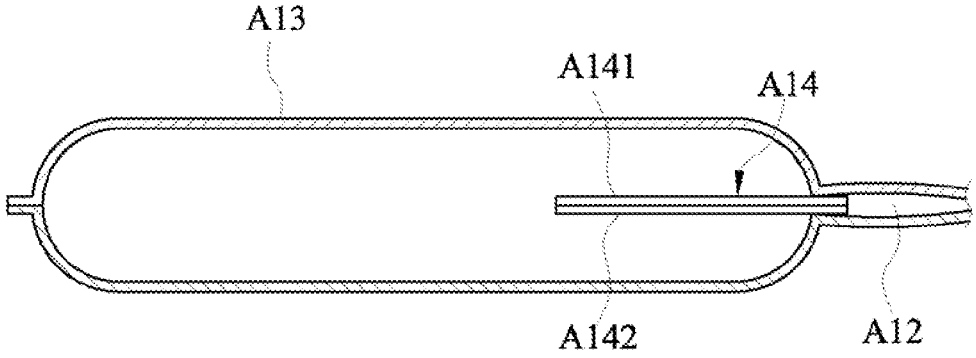
Fig.1B(PRIOR ART)
FIG. 1B is a cross sectional view of the air-packing bag in the prior art after filling air.
Figure 1C:
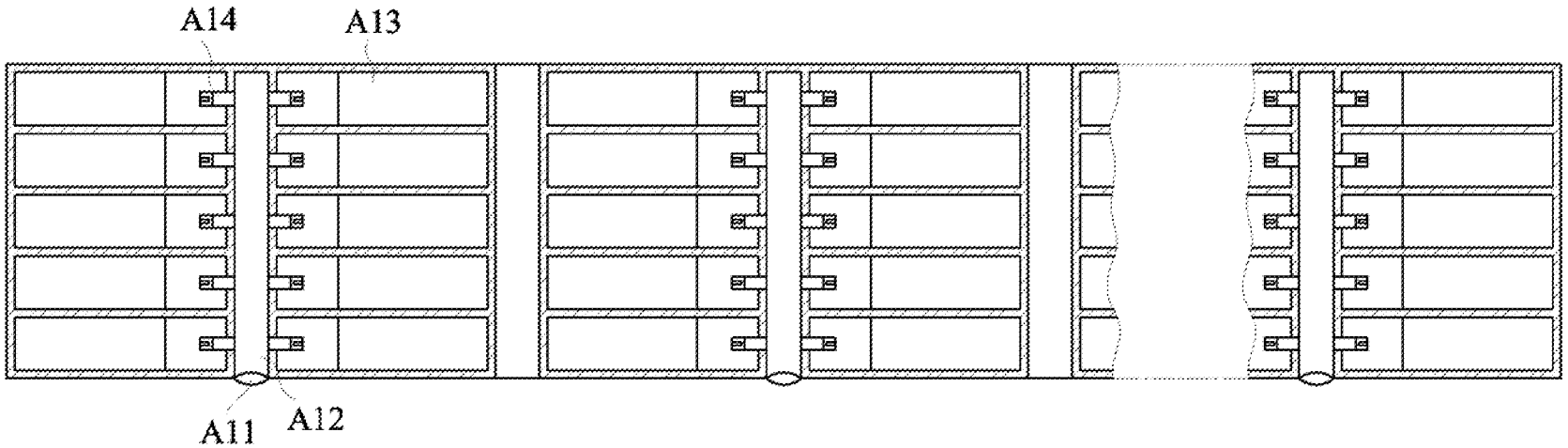
Fig.1C(PRIOR ART)
FIG. 1C is an explanatory diagram of the air-packing bag in the prior art before filling air (2).
Figure 1D:
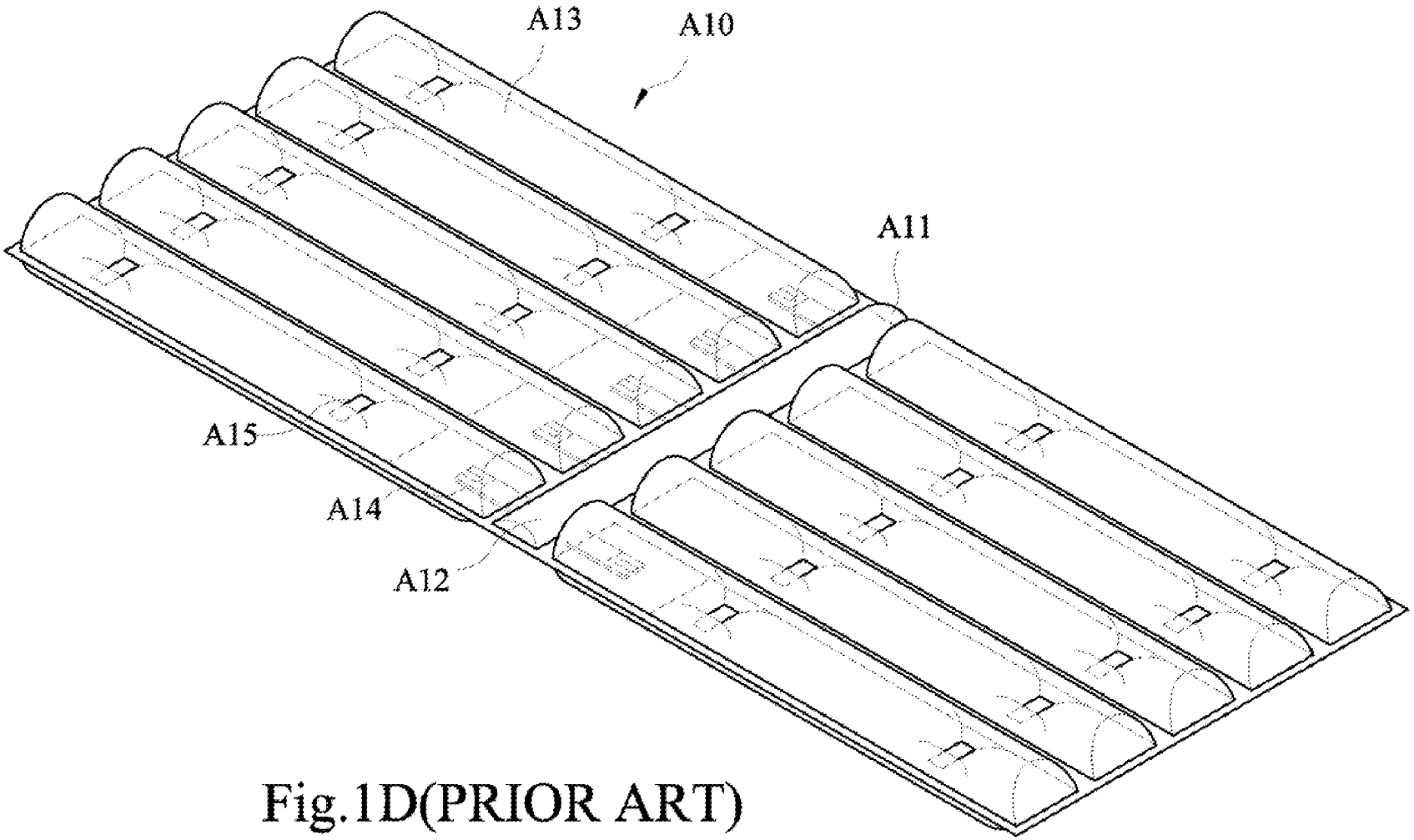
Fig.1D(PRIOR ART)
FIG. 1D is an explanatory diagram of the air-packing bag in the prior art after filling air.
Figure 2B:
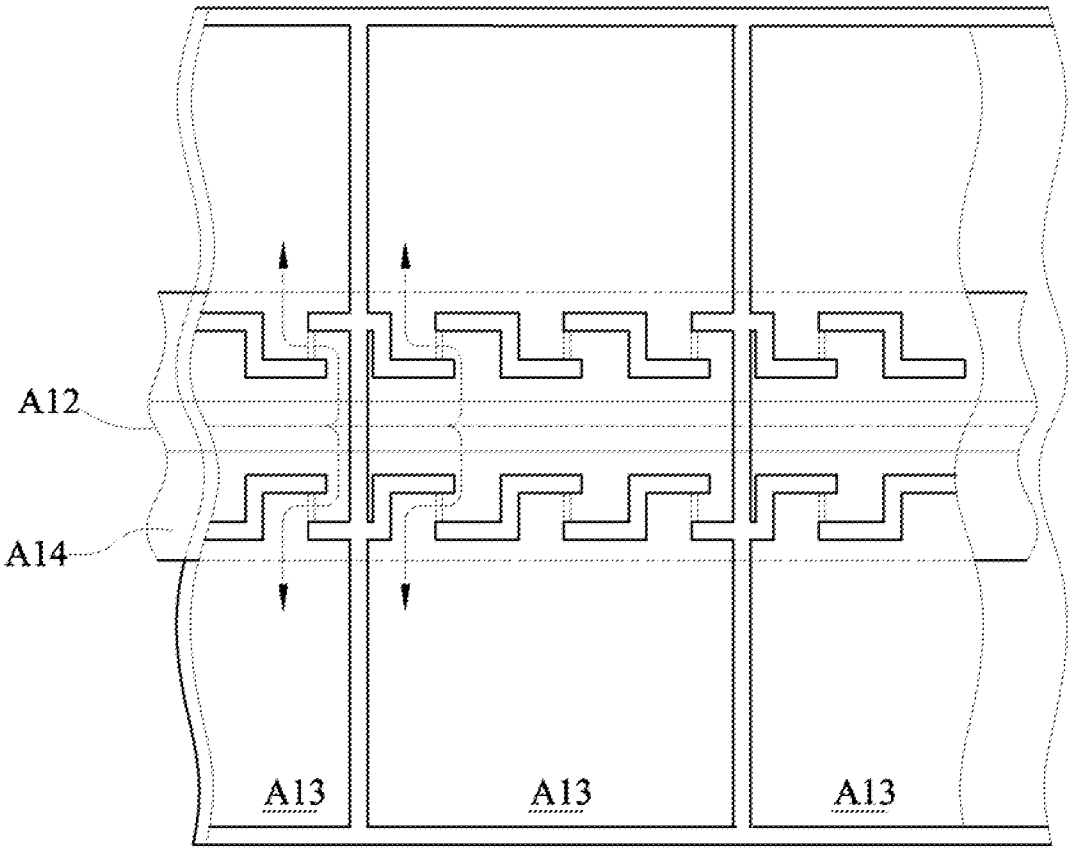
Fig.2B(PRIOR ART)
FIG. 2B is an explanatory diagram of another air-packing bag in the prior art before filling air (1).
Figure 2A:
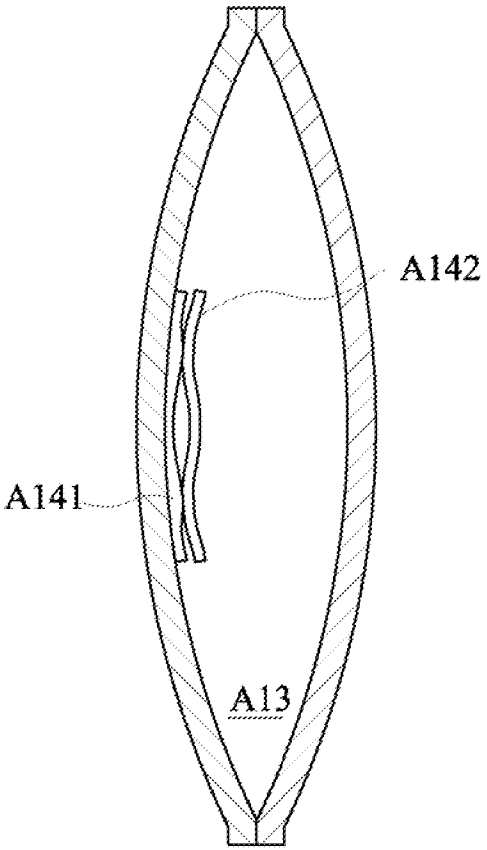
Fig.2A(PRIOR ART)
FIG. 2A is a cross sectional view of another air-packing bag in the prior art after filling air.
Figure 2C:
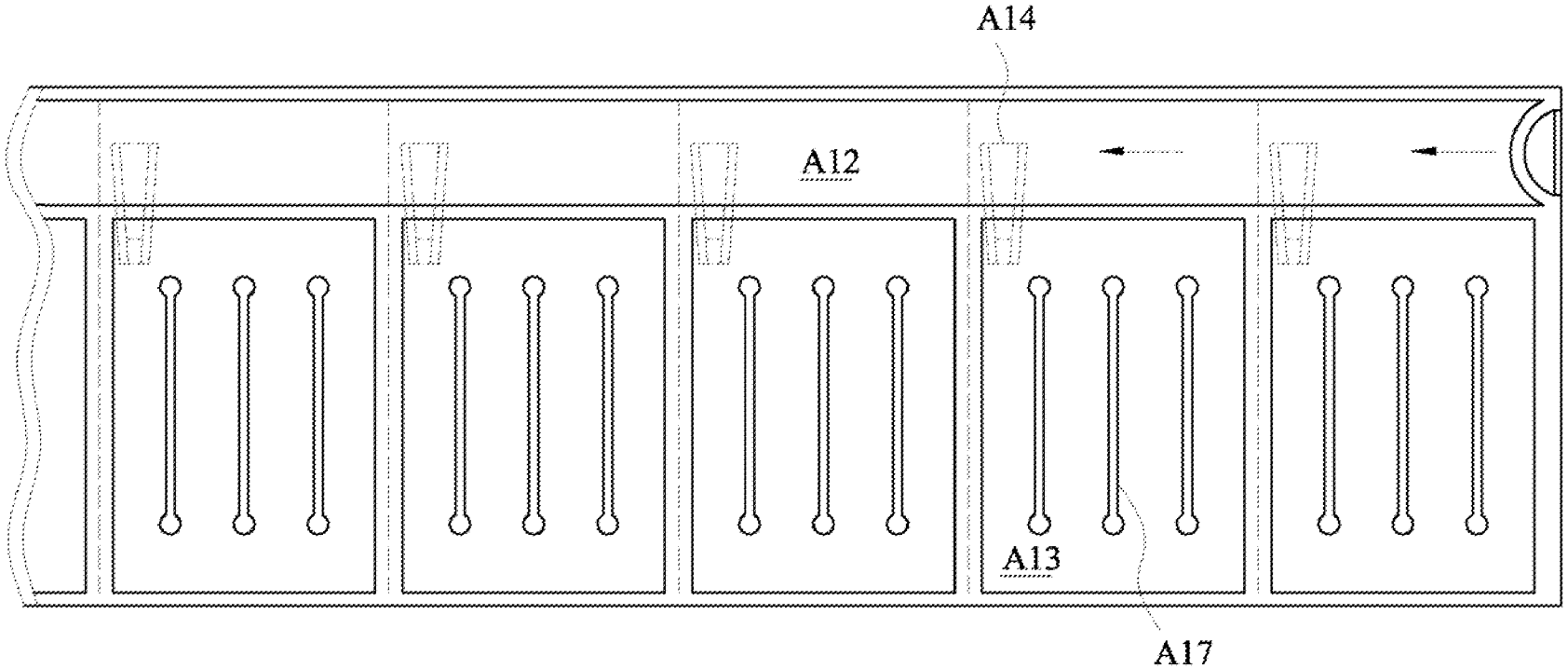
Fig.2C(PRIOR ART)
FIG. 2C is an explanatory diagram of another air-packing bag in the prior art before filling air (2).
Figure 3A:
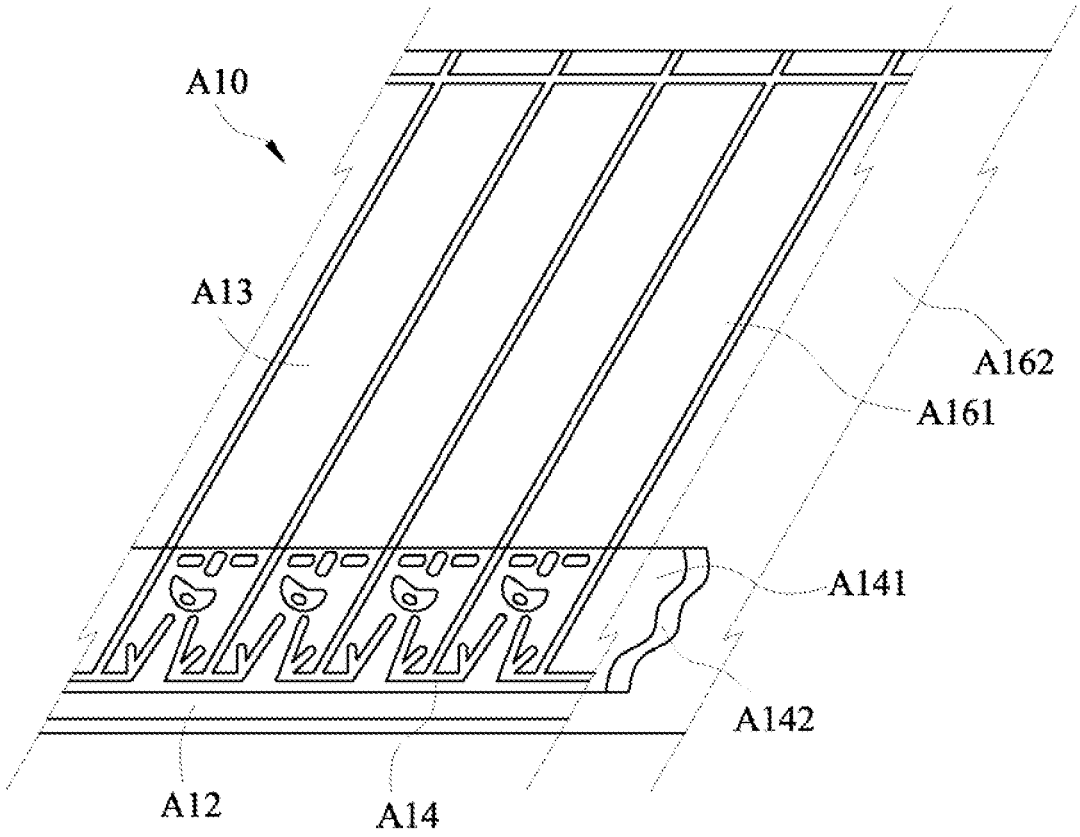
Fig.3A(PRIOR ART)
FIG. 3A is an explanatory diagram for an air valve's structure of an air-packing bag in the prior art.
Figure 3B:
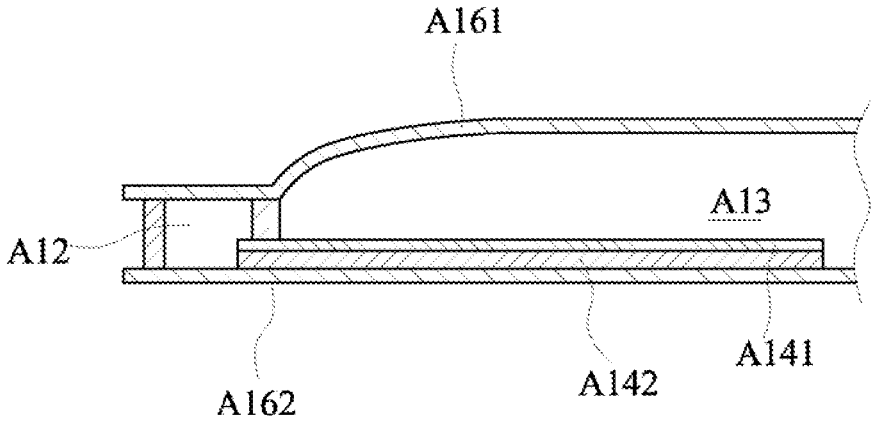
Fig.3B(PRIOR ART)
FIG. 3B is a cross sectional view for the air valve's structure of the air-packing bag in the prior art.
Figure 4:
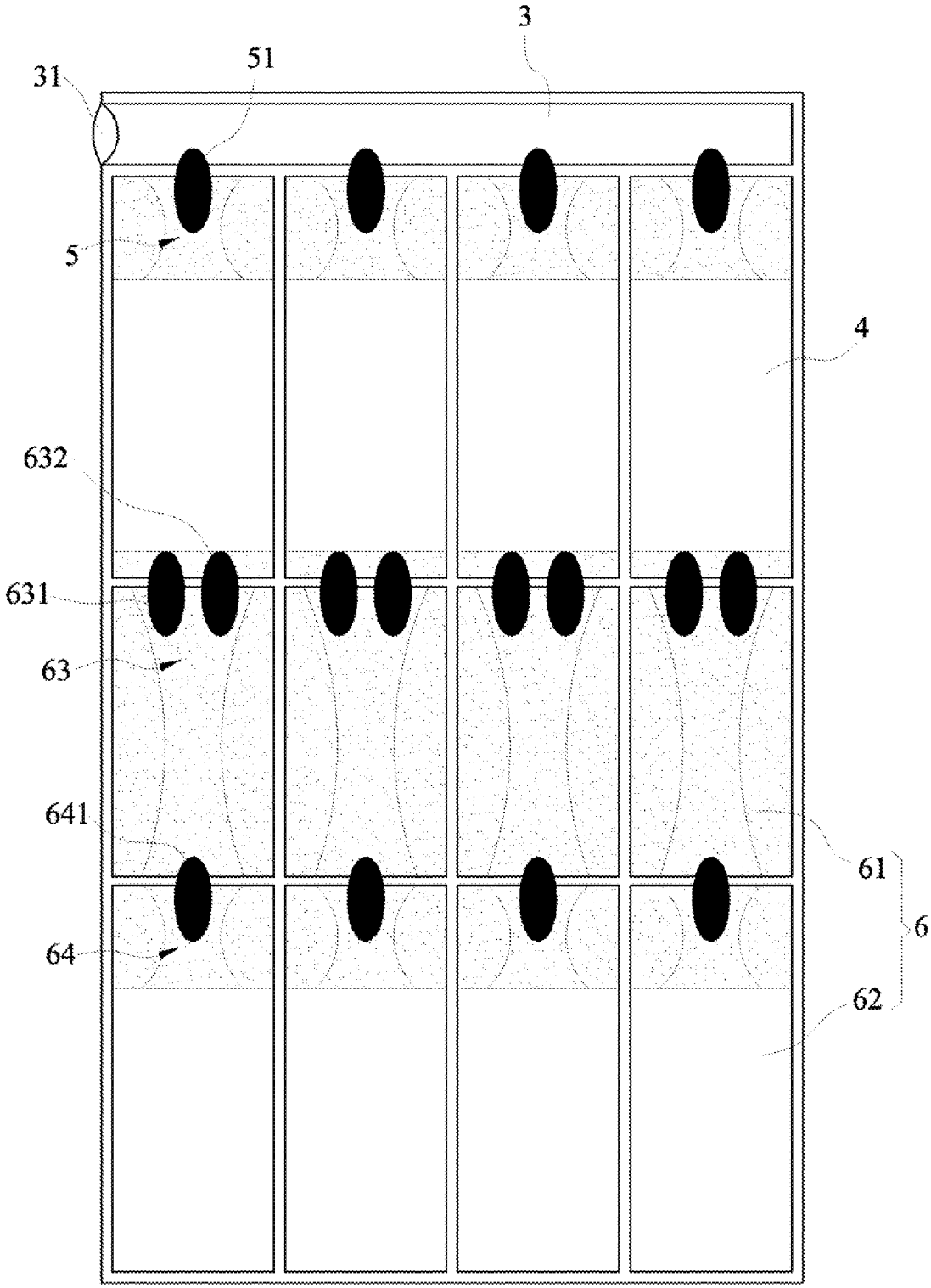
FIG. 4 is a plane view for the first embodiment of the present invention before filling air.
Figure 5:
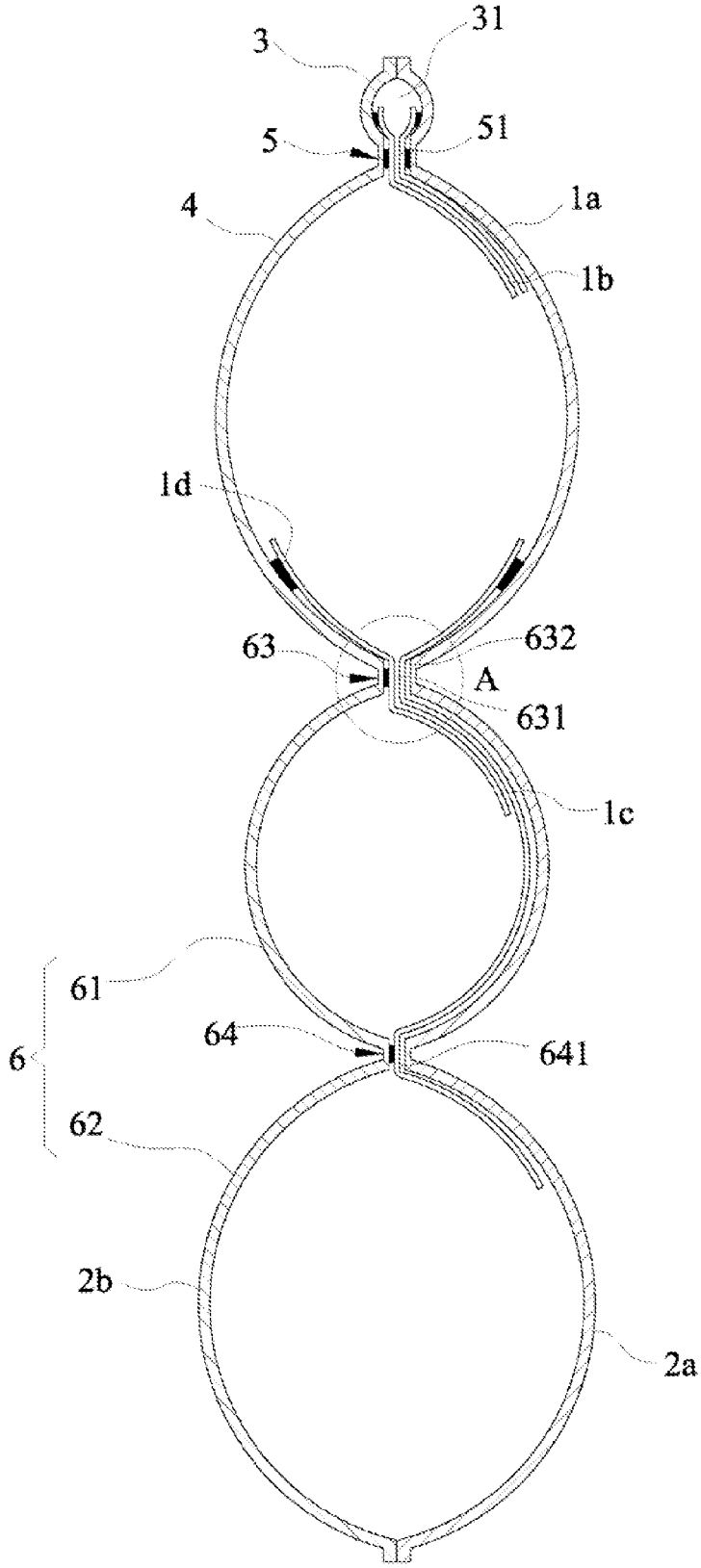
FIG. 5 is a cross sectional view for first embodiment of the present invention before filling air.
Figure 5A:
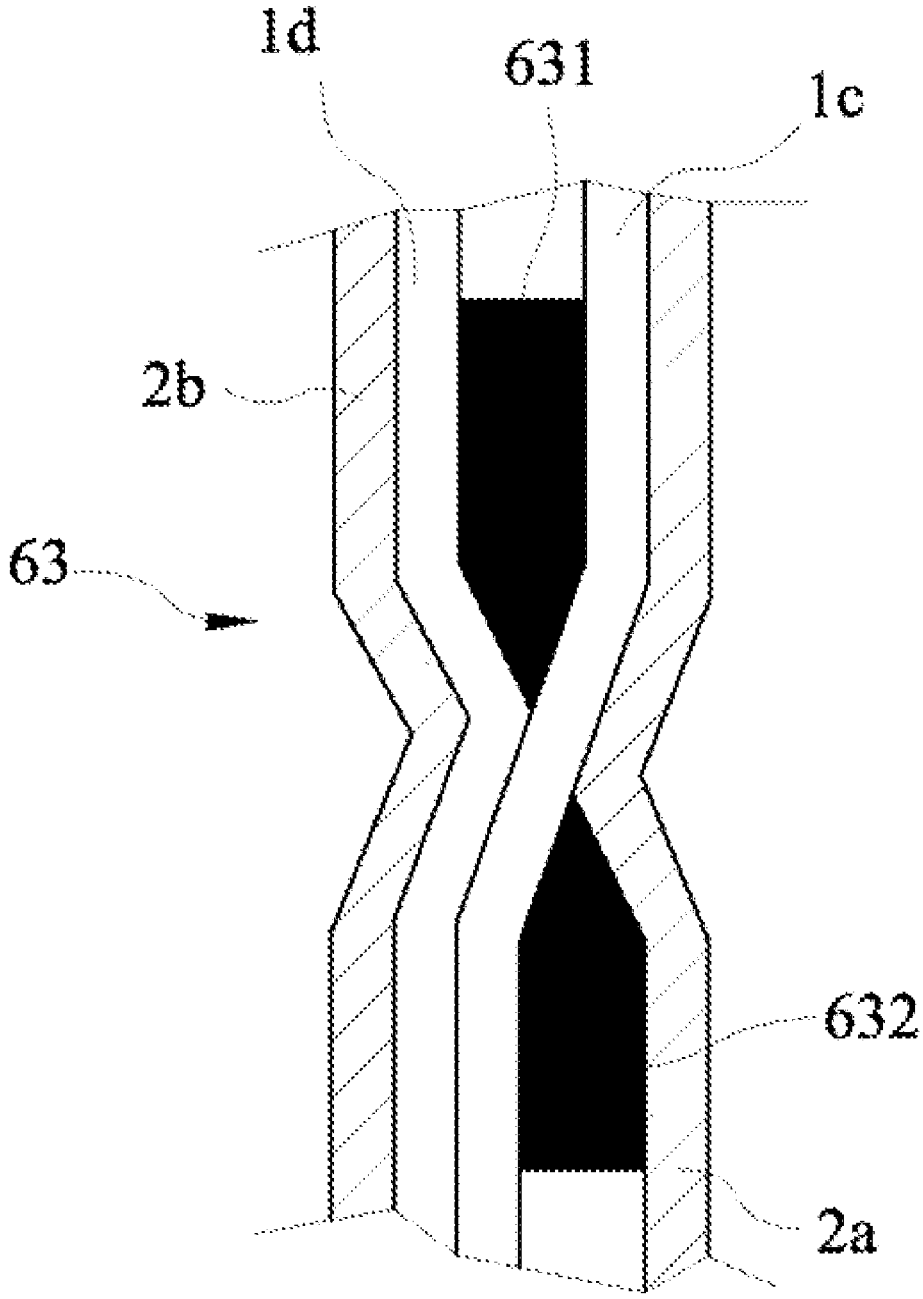
FIG. 5A is the cross sectional view of the portion A in FIG. 5.
Figure 6:
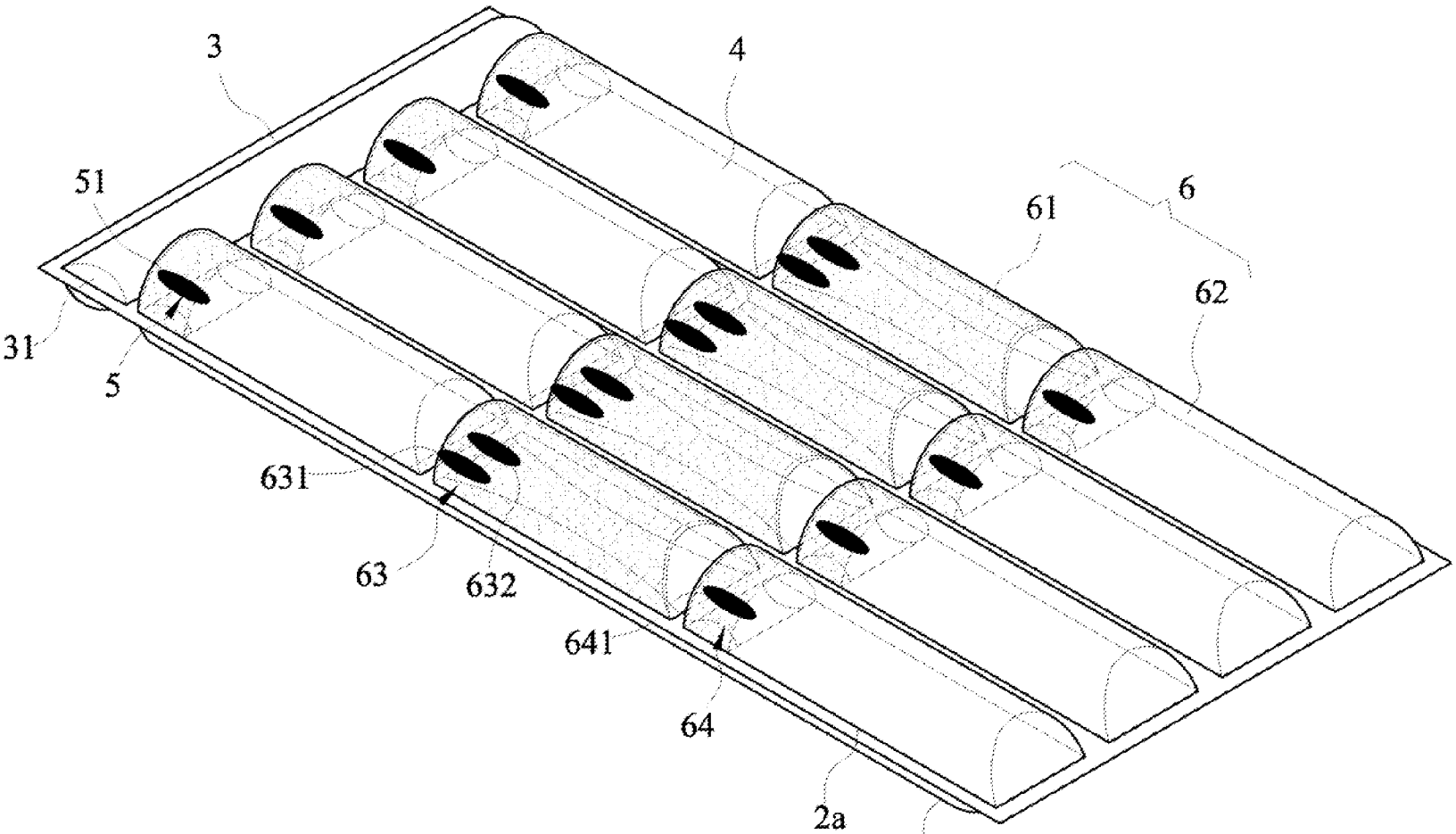
FIG. 6 is a perspective view for the first embodiment of the present invention after filling air.

Please refer to FIGS. 4, 5, 5A and 6, which illustrate the first embodiment of a multi-sectional airtight seal for continuous air-filling. FIG. 4 is a plane view before filling air; FIG. 5 is a cross sectional view after filling air; FIG. 5A is a cross sectional view for the portion A in FIG. 5; FIG. 6 is a perspective view after filling air.

The multi-sectional airtight seal for continuous air-filling includes an input passage 3, plural main air tubes 4, plural single-path valve devices 5, and plural auxiliary tubes 6.

The input passage 3 is operative as space formed by thermal-sealing the two outer films 2*a* and 2*b*, or space formed by thermal-sealing the two inner films 1*a* and 1*b*. The input passage 3 includes a pneumatic hole 31 for filling external air.

The plural main air tubes 4 are operative as air storage formed by thermal-sealing the two outer films 2*a*, 2*b*. The plural main air tubes 4 are aligned parallel to a lateral side of the input passage 3.

The plural single-path valve devices 5 are formed by applying heatproof material between the two inner films 1*a*, 1*b* and then thermal-sealing the two inner films 1*a*, 1*b*. The single-path valve device 5 includes a filling passage 51 for connecting the main air tube 4 and the input passage 3.

The plural auxiliary tubes 6 are located at the ends of the plural main air tubes 4. Each of the auxiliary tubes 6 includes a first sub-tube 61, a second sub-tube 62, the first valve device 63 and the second valve device 64.

The first sub-tube 61 is operative as air storage formed by thermal-sealing the two outer films 2*a*, 2*b*. The first sub-tube 61 is serially connecting with an end of the main air tube 4.

The second sub-tube 62 is also operative as air storage formed by thermal-sealing the two outer films 2*a*, 2*b*. The second sub-tube 62 is serially connecting with an end of the first sub-tube 61.

The first valve device 63 includes a first filling passage 631 and a second filling passage 632. The first filling passage 631 is formed by applying heatproof material between the two inner films 1*c*, 1*d* and thermal-sealing the two inner films 1*c*, 1*d*, thereby allowing through-linking between the first sub-tube 61 and the main air tube 4. The second filling passage 632 is formed by applying heatproof material between one of the inner films 1*c* and one of the outer films 2*a* and thermal-sealing one of the inner films 1*c* and one of the outer films 2*a*. The first filling passage 631 and the second filling passage 632 are located respectively at the left and right sides of the first valve device 63.

The second valve device 64 is formed by applying heatproof material between one of the inner films 1*c* and one of the outer films 2*a*, and thermal-sealing one of the inner films 1*c* and one of the outer films 2*a*. The second valve device 64 includes a filling passage 641 for connecting the second sub-tube 62 and the second filling passage 632, thereby allowing through-linking between the second sub-tube 62 and the main air tube 4.

In the structure described above, not each of the inner films has the same length. For example, the single-path valve device 5 has its inner films 1*a*, 1*b* with the same length, but the first valve device 63 has the inner film 1*c* longer than the inner film 1*d*. Furthermore, to apply heatproof material between the inner film and the outer film or between the two inner films by intervals provides airflow passages through the heatproof material.

When filling air, the external air enters the pneumatic hole 31 to expand the input passage 3, thereby pulling outwards the two inner films 1*a*, 1*b* to open the filling passage 51 of the single-path valve device 5 and allow the external air to enter and expand the main air tube 4. Next, the external air in the main air tube 4 will open the first filling passage 631 and the second filling passage 632 of the first valve device 63. Then some of the external air in the first filling passage 631 enters and expands the first sub-tube 61, while some of the external air enters the second valve device 64 through the second filling passage 632 and then enters and expands the second sub-tube 62 through the filling passage 641 of the second valve device 64.

After all the air tubes are expanded, the inner air pressure in the first sub-tube 61 will press the two inner films 1*c*, 1*d* to tightly attach to the outer film 2*a*, covering the first filling passage 631 to seal the first sub-tube 61. The inner air pressure in the second sub-tube 62 will press the inner film 1*c* to tightly attach to the outer film 2*a*, covering the filling passage 641 of the second valve device 64 to seal the second sub-tube 62. Meanwhile, the inner air pressure in the main air tube 4 presses the two inner films 1*a*, 1*b* to tightly attach to the outer film 2*a*, covering the single-path the filling passage 51 of valve device 5 to seal the main air tube 4. Therefore, the air in the main air tube 4, the first sub-tube 61 and the second sub-tube 62 will not leak out to achieve an airtight effect. So when any of the air tubes is broken, the structure disclosed by the present invention is capable of preventing the other air tubes from leaking air to maintain shock-absorption and cushion capabilities.

In addition, the air pressure in the main air tube 4, the first sub-tube 61 and the second sub-tube 62 will be equivalent. Therefore, when filling air the first filling passage 631 and the second filling passage 632 will maintain an equivalent pressure. The second filling passage 632 will not be sealed and cause the second sub-tube 62 unable to fill air if the first sub-tube 61 is pressed by its air pressure to cover the first filling passage 631. Hence, the structure disclosed by the present invention enables the main air tube 4, the first sub-tube 61 and the second sub-tube 62 to fill air at the same time. This not only accelerates the filling speed, the manufacturing cost may also be further reduced.

Figure 7:
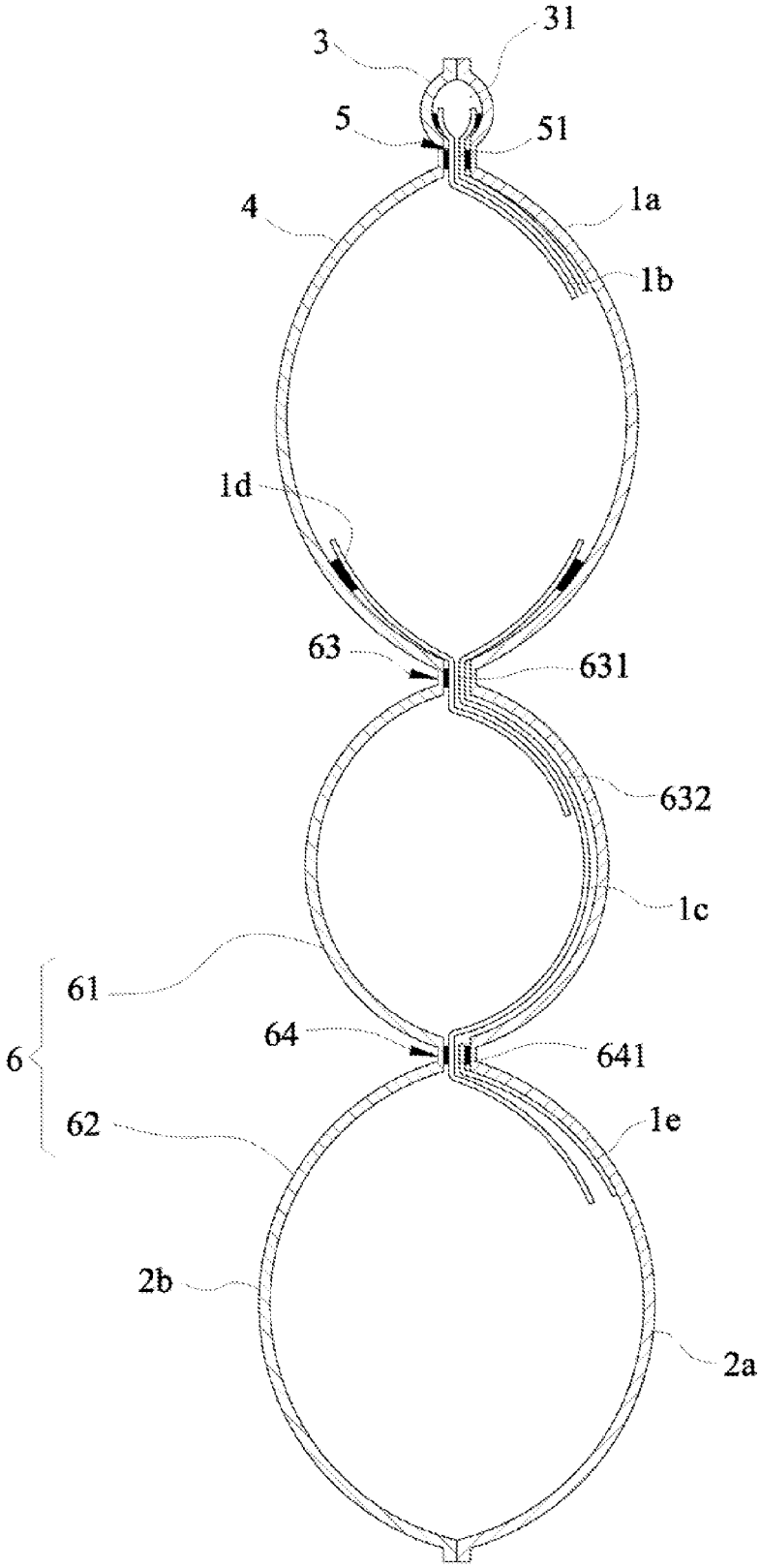
FIG. 7 is a cross sectional view for the second embodiment of the present invention after filling air.

Please refer to FIG. 7, which is a cross sectional view according to the second embodiment of a multi-sectional airtight seal for continuous air-filling after filling air.

In the second embodiment, plural single-path valve devices 5 are formed by applying heatproof material between the two inner films 1*a*, 1*b* and thermal-sealing the two inner films 1*a*, 1*b*, thereby providing airflow passages through the heatproof material. The second valve device 64 is formed by applying heatproof material between the two inner films 1*d*, 1*e* and thermal-sealing the two inner films 1*d*, 1*e*. The second valve device 64 includes a filling passage 641 for connecting the second sub-tube 62 and the second filling passage 632 to allow through-linking between the second sub-tube 62 and the main air tube 4.

In the structure described above, each of the plural single-path valve devices 5 may be formed by applying heatproof material between one of the inner films 1*a* and one of the outer films 2*a*, and by thermal-sealing one of the inner films 1*a* and one of the outer film 2*a*, thereby providing a airflow passage through the heatproof material.

Figure 8:
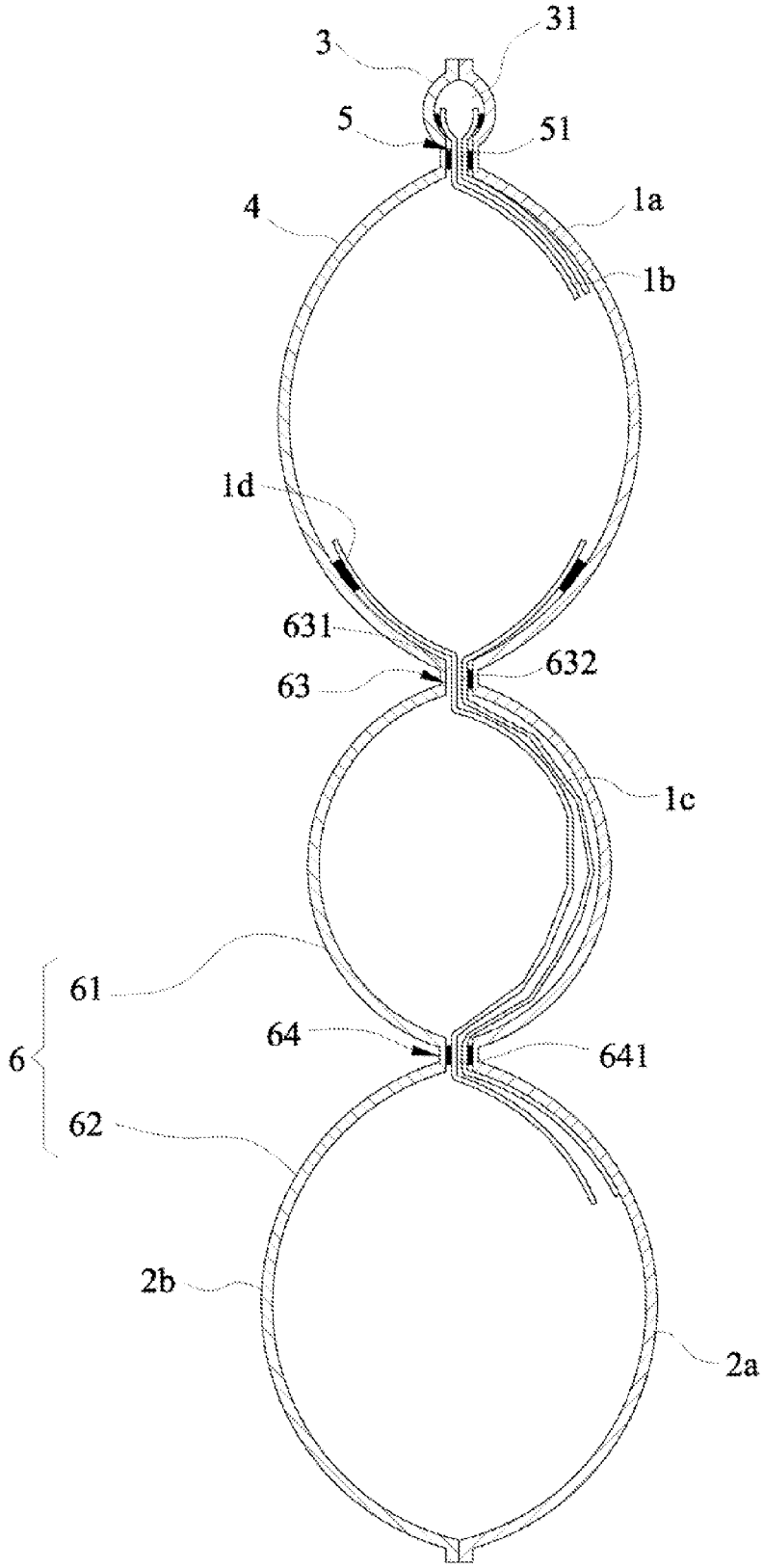
FIG. 8 is a plane view for the third embodiment of the present invention before filling air.

Please refer to FIG. 8, which is a plane view according to the third embodiment of a multi-sectional airtight seal for continuous air-filling before filling air.

The first valve device 63 of each of the plural auxiliary tubes 6 includes the first filling passage 631 and the second filling passage 632; wherein the first filling passage 631 is formed by applying heatproof material between one of the inner films 1*d* and one of the outer films 2, and by thermal-sealing one of the inner films 1*d* and one of the outer films 2*b* thereby connecting the first sub-tube 61 and the main air tube 4. The second filling passage 632 is formed by applying heatproof material between the two inner films 1*c*, 1*d*, and thermal-sealing the two inner films 1*c*, 1*d*. The second valve device 64 is formed by thermal-sealing the two inner films 1*c*, 1*d*. The second valve device 64 includes a filling passage 641 for connecting the second sub-tube 62 and the second filling passage 632, thereby allowing through-linking between the second sub-tube 62 and the main air tube 4.

Figure 9:
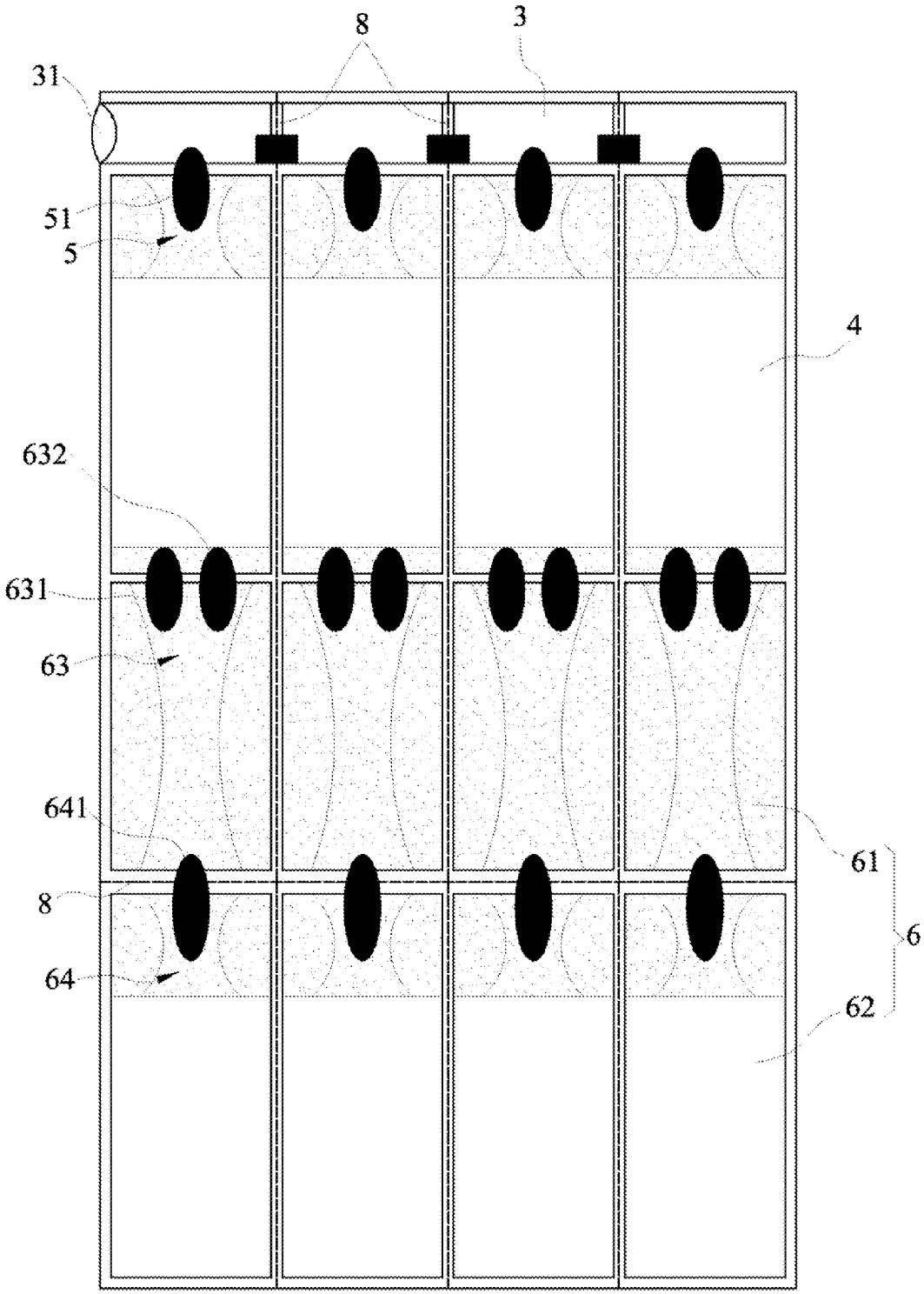
FIG. 9 is a plane view for the fourth embodiment of the present invention before filling air.

Please refer to FIG. 9, which is a plane view according to the fourth embodiment of a multi-sectional airtight seal for continuous air-filling before filling air.

The structure disclosed in the fourth embodiment further includes a cutting line 8, located at the serial connecting portion between the first sub-tube 61 and the second sub-tube 62. Spilt along the cutting line 8 will separate the first sub-tube 61 and the second sub-tube 62. The cutting line 8 may be configured between plural main air tubes 4 and between plural auxiliary tubes 6. Then cutting along the cutting line 8 will separate the adjacent main air tubes 4 and separate the adjacent auxiliary tubes 6. Moreover, the airtight seal may be configured with cutting lines by poking-line means. The user may tear apart the air tubes along the cutting lines for independent use. The configuration of the cutting lines 8 enable the air tubes to be mass produced and used independently.

Figure 10:
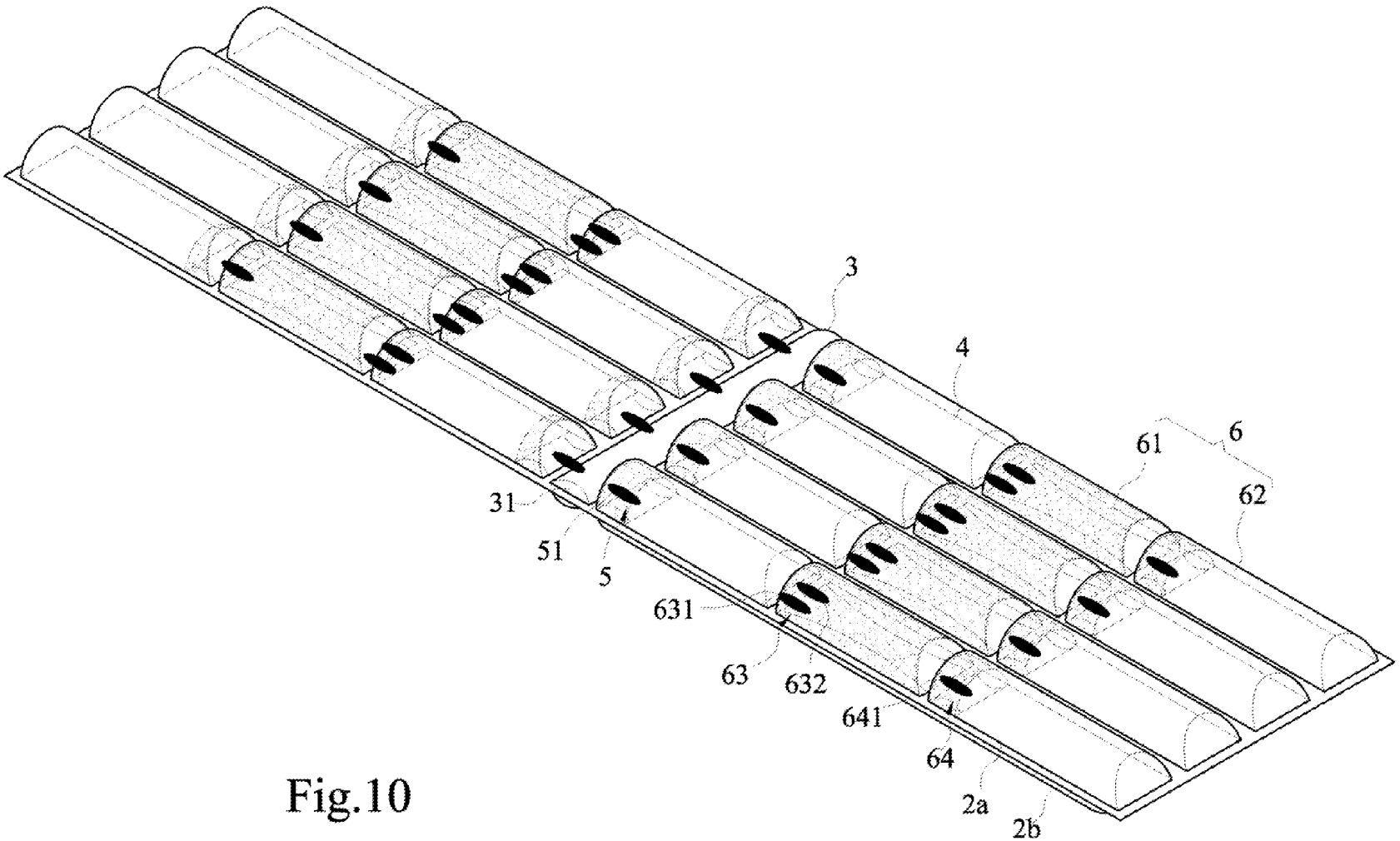
FIG. 10 is a perspective view for the fifth embodiment of the present invention after filling air.

Please refer to FIG. 10, which is a perspective view according to the fifth embodiment of a multi-sectional airtight seal for continuous air-filling after filling air.

In the fifth embodiment, plural main air tubes 4 are aligned parallel respectively to the two lateral sides of the input passage 3. When filling air, the external air enters the pneumatic hole 31 and then expand the input passage 3 to open the filling passage 51 of the single-path valve device 5. Afterwards, the external air is allowed to enter and expand the main air tubes 4 at the two lateral sides of the input passage 3. Some of the external air enters through the first valve device 63 to expand the first sub-tube 61, while some of the external air enters through the first valve device 63 and the second valve device 64 to expand the second sub-tube 62.

The input passage 3 may be configured with a cutting line 8 thereon. After filling air and expanded, the main air tubes 4 and the auxiliary tubes 6 at the lateral sides of the input passage 3 may be torn apart along the cutting line respectively for independent use.

Figure 11:
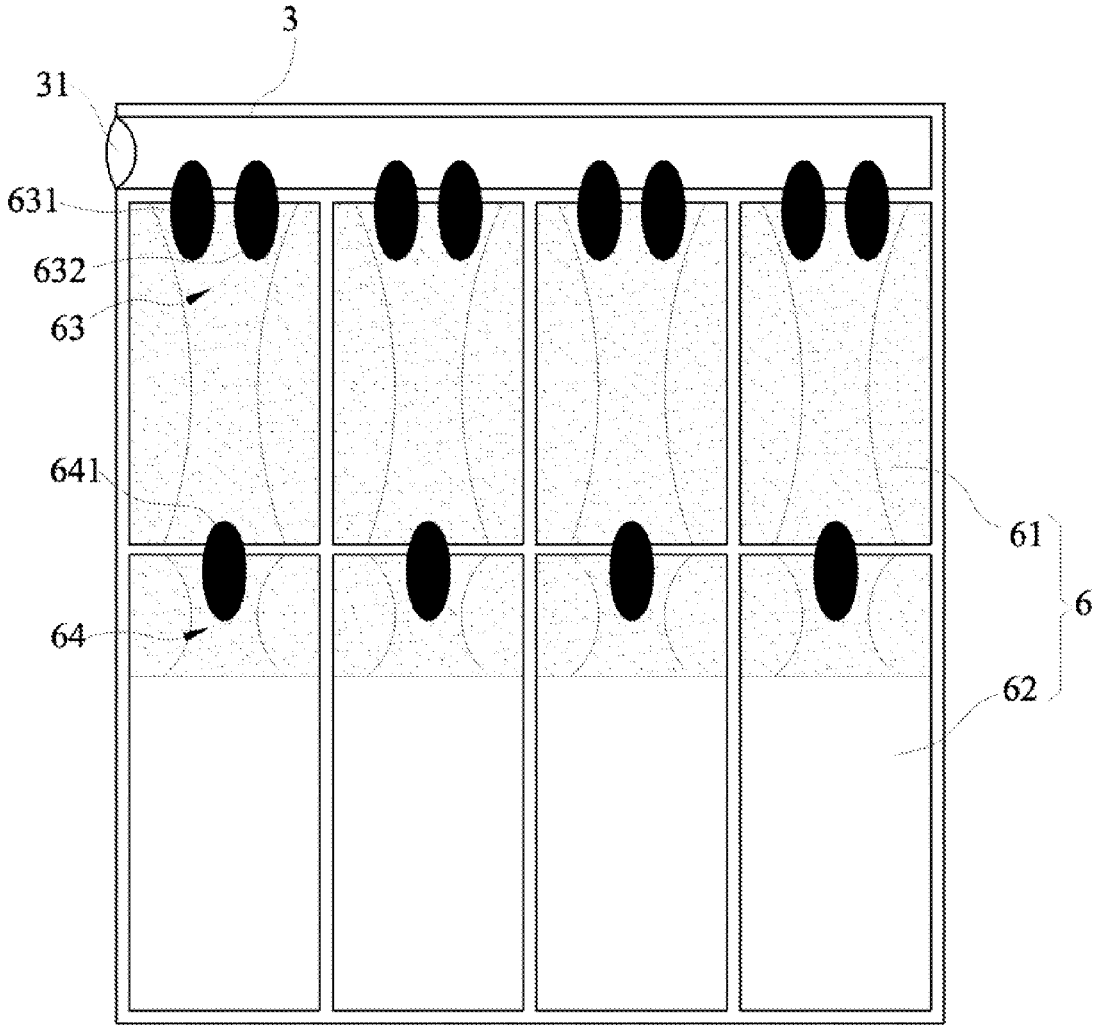
FIG. 11 is a plane view for the sixth embodiment of the present invention before filling air.
Figure 12:
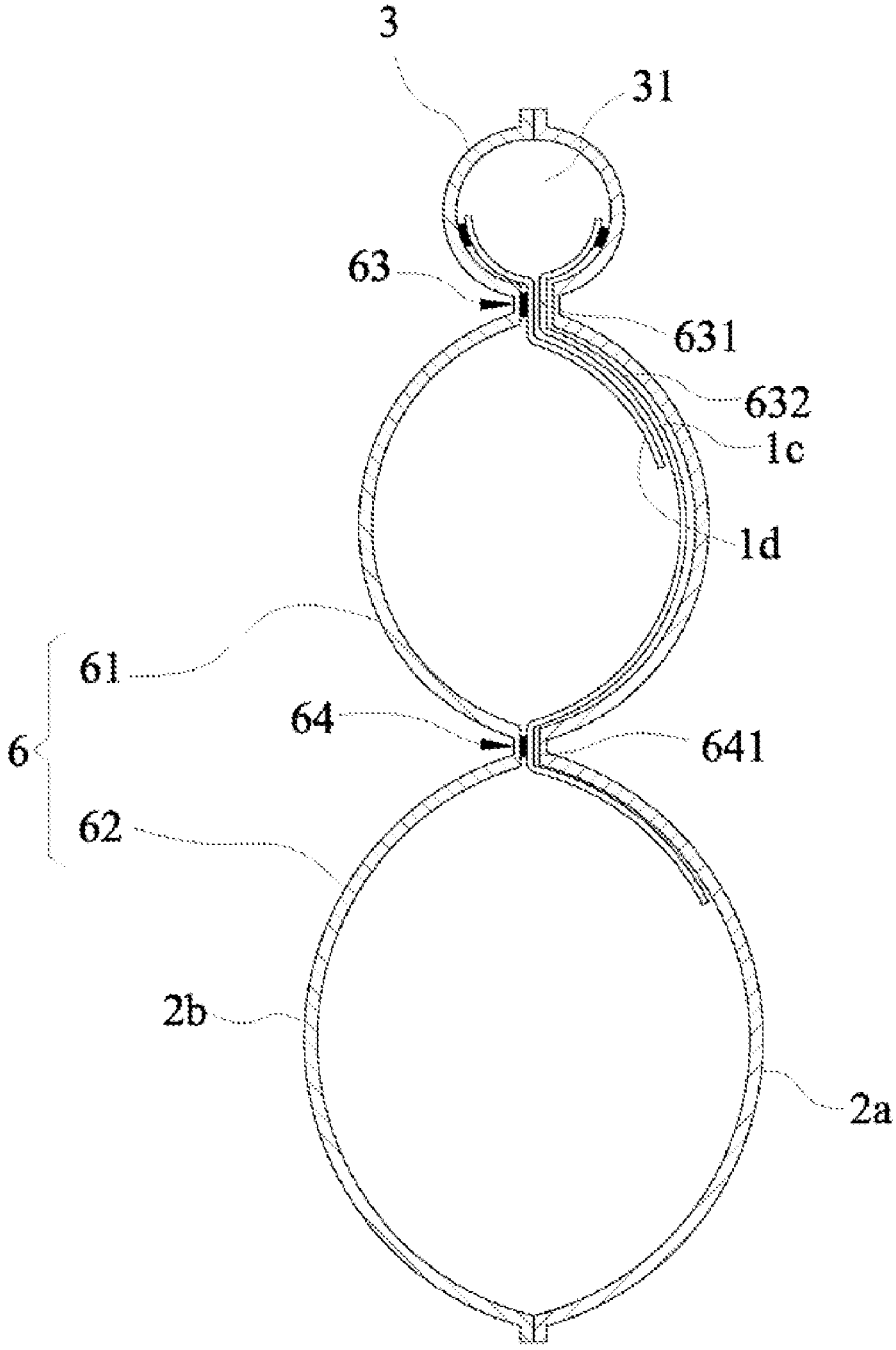
FIG. 12 is a cross sectional view for the sixth embodiment of the present invention after filling air.
Figure 13:
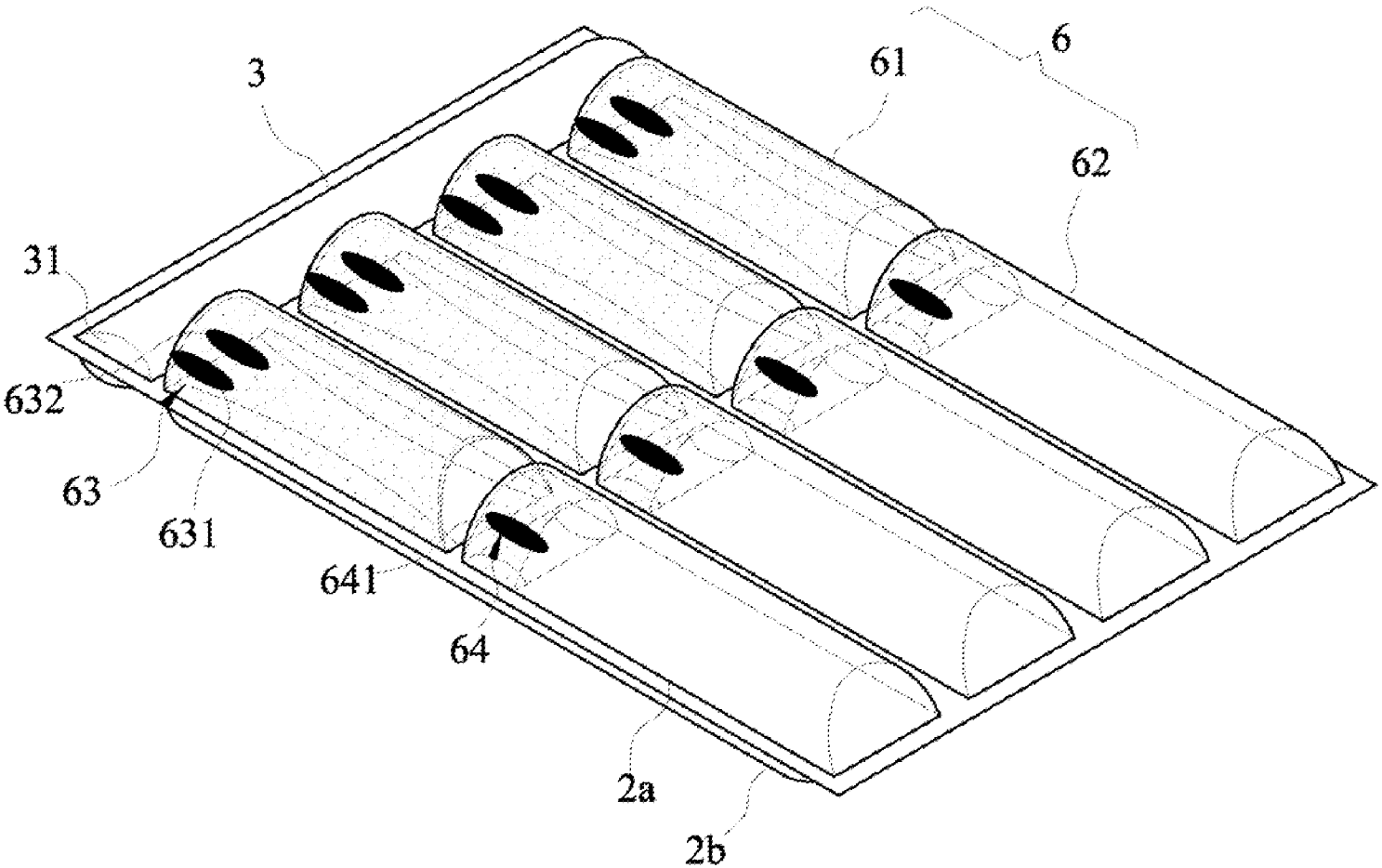
FIG. 13 is a perspective view for the sixth embodiment of the present invention after filling air.

Please refer to FIGS. 11, 12 and 13, which illustrate the sixth embodiment of a multi-sectional airtight seal for continuous air-filling. FIG. 11 is a plane view before filling air; FIG. 12 is a cross sectional view after filling air; FIG. 13 is a perspective view after filling air.

The multi-sectional airtight seal for continuous air-filling mainly includes an input passage 3 and plural auxiliary tubes 6.

The input passage 3 is operative as space formed by thermal-sealing the two outer films 2*a*, 2*b*, or formed by thermal-sealing the two inner films 1*c*, 1*d*. The input passage 3 includes a pneumatic hole 31 for filling external air.

The plural auxiliary tubes 6 are located at the lateral side of the input passage 3. Each of the auxiliary tubes 6 includes first sub-tubes 61, second sub-tubes 62, first valve devices 63 and second valve devices 64.

The first sub-tube 61 is operative as air storage formed by thermal-sealing the two outer films 2*a*, 2*b*. The first sub-tube 61 is aligned parallel to the lateral side of the input passage 3.

The second sub-tube 62 is operative as air storage formed by thermal-sealing the two outer films 2*a*, 2*b*. The second sub-tube 62 is serially connecting with an end of the first sub-tube 61.

The first valve device 63 includes a first filling passage 631 and a second filling passage 632. The first filling passage 631 is formed by applying heatproof material between the two inner films 1*c*, 1*d*, and thermal-sealing the two inner films 1*c*, 1*d*, thereby allow through-linking between the first sub-tube 61 and the input passage 3. The second filling passage 632 is formed by applying heatproof material between one of the inner films 1*c* and one of the outer films 2*a* and thermal-sealing the inner film 1*c* and the outer film 2*a*.

The second valve device 64 is formed by applying heatproof material between one of the inner films 1*c* and one of the outer films 2*a* and thermal-sealing the inner film 1*c* and the outer film 2*a*. The second valve device 64 includes a filling passage 641 for connecting the second sub-tube 62 and the second filling passage 632 to allow through-linking between the second sub-tube 62 and the input passage 3.

In the structure described above, the inner film 1*c* of the first valve device 63 is longer than the inner film 1*d*. The heatproof material may be applied between the two inner films 1*c*, 1*d* by intervals, or between the inner film 1*c* and the outer film 2*a*, to provide airflow passages by the heatproof material. Besides, the serial connecting portion of the first sub-tube 61 and the second sub-tube 62 is configured with a cutting line 8. Splitting along the cutting line 8 will separate the first sub-tube 61 and the second sub-tube 62. The airtight seal may be configured with cutting lines by poking-line means for the user to tear apart the air tubes along the cutting lines for independent use.

Furthermore, the first filling passage 631 may be formed by applying heatproof material between the two inner films 1*c*, 1*d* and by thermal-sealing the two inner films 1*c*, 1*d*, or formed by applying heatproof material between the inner film 1*c* and the outer film 2*b* and by thermal-sealing the inner film 1*c* and the outer film 2*b*. The second filling passage 632 may be formed by applying heatproof material between the inner film 1*c* and the outer film 2*a* and by thermal-sealing the inner film 1*c* and the outer film 2*a*, or formed by applying heatproof material between the two inner films 1*c*, 1*d* and by thermal-sealing the two inner films 1*c*, 1*d*.

When filling air, the external air that enters the pneumatic hole 31 will expand the input passage 3 to pull out the two inner films 1*c*, 1*d* and open the first filling passage 631 of the first valve device 63, thereby enable the external air to enter and expand the first sub-tube 61. Meanwhile the external air in the input passage 3 will open the second filling passage 632 of the first valve device 63 to enter the second valve device 64 through the second filling passage 632, passing through the filling passage 641 of the second valve device 64, entering and expanding the second sub-tube 62 eventually.

After the first sub-tube 61 and the second sub-tube 62 are filled with air and expanded, the inner air pressure in the first sub-tube 61 will press the two inner films 1*c* and 1*d* to attach tightly to the outer film 2*a*, covering the first filling passage 631 to seal the first sub-tube 61. The inner air pressure in the second sub-tube will also press the inner film 1*c* to attach tightly to the outer film 2*a*, covering the filling passage 641 of the second valve device 64 to seal the second sub-tube 62, thereby preventing the external air in the first sub-tube 61 and the second sub-tube 62 from leaking out and an achieving airtight effect. Therefore, the structure disclosed by the present invention enables the first sub-tube 61 and the second sub-tube 62 to be filled at the same time. This not only accelerates the filling speed, but also further reduces the manufacturing cost. Besides, when any of the air tubes is broken, this structure may prevent the other air tubes from leaking air and maintain shock-absorption and cushion capabilities.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A multi-sectional airtight seal for continuous air-filling, formed by thermal-sealing two up-down stacked outer films and a plurality of inner films between the two outer films, comprising:

an input passage, located between the two outer films;

a plurality of main air tubes, aligned parallel to a lateral side of the input passage, operative as air storage formed by thermal-sealing the two outer films;

a plurality of single-path valve devices, connecting the main air tube and the input passage; and a plurality of auxiliary tubes, located at an end of each of the plurality of main air tubes, each of the auxiliary tubes comprising:

a first sub-tube, serially connecting with the main air tube, operative as air storage formed by thermal-sealing the two outer films;

a second sub-tube, serially connecting with the first sub-tube, operative as air storage formed by thermal-sealing the two outer films; and a first valve device, comprising a first filling passage and a second filling passage, the first filling passage connecting the first sub-tube and the main air tube, the second filling passage connecting the second sub-tube and the main air tube.

2. The multi-sectional airtight seal of claim 1 further comprising a plurality of second valve devices, a filling passage being formed by applying heatproof material to partial surface of the inner film and thermal-sealing without attaching other films, thereby through-linking the second sub-tube and the input passage.

3. The multi-sectional airtight seal of claim 2, wherein the second valve device is formed by thermal-sealing one of the inner films and one of the outer films.

4. The multi-sectional airtight seal of claim 2, wherein the second valve device is formed by thermal-sealing two of the inner films.

5. The multi-sectional airtight seal of claim 1 further comprising a cutting line located at the serial connecting portion of the first sub-tubes and the second sub-tubes for being cut along to separate the first sub-tube and the second sub-tube.

6. The multi-sectional airtight seal of claim 1 further comprising a cutting line located between the plurality of first sub-tubes and between the plurality of second sub-tubes for being cut along to separate the adjacent plurality of first sub-tubes and to separate the adjacent plurality of second sub-tubes.

7. The multi-sectional airtight seal of claim 1, wherein the two inner films have different lengths.

8. The multi-sectional airtight seal of claim 1, wherein the input passage is space formed by thermal-sealing the two outer films.

9. The multi-sectional airtight seal of claim 1, wherein the input passage is space formed by thermal-sealing the two inner films.

10. The multi-sectional airtight seal of claim 1, wherein the single-path valve device has a filling passage formed by applying heatproof material to partial surface of the inner film and thermal-sealing without attaching other films.

11. The multi-sectional airtight seal of claim 10, wherein the single-path valve device is formed by thermal-sealing one of the inner films and one of the outer films.

12. The multi-sectional airtight seal of claim 1, wherein the single-path valve device is formed by thermal-sealing the two inner films.

13. The multi-sectional airtight seal of claim 1, wherein the first filling passage is formed by applying heatproof material between the two inner films and thermal-sealing the two inner films.

14. The multi-sectional airtight seal of claim 13, wherein the second filling passage is formed by applying heatproof material between one of the inner films and one of the outer films and thermal-sealing said inner film and said outer film.

15. The multi-sectional airtight seal of claim 1, wherein the first filling passage is formed by applying heatproof material between one of the inner films and one of the outer films and thermal-sealing said inner film and said the outer film.

16. The multi-sectional airtight seal of claim 15, wherein the second filling passage is formed by applying heatproof material between the two inner films and thermal-sealing the two inner films.

* * * * *